US007973722B1

(12) United States Patent
Hill et al.

(10) Patent No.: US 7,973,722 B1
(45) Date of Patent: Jul. 5, 2011

(54) ELECTRONIC DEVICE WITH CONDUCTIVE HOUSING AND NEAR FIELD ANTENNA

(75) Inventors: Robert J. Hill, Salinas, CA (US); Qingxiang Li, Mountain View, CA (US)

(73) Assignee: Apple Inc., Cupertino, CA (US)

( * ) Notice: Subject to any disclaimer, the term of this patent is extended or adjusted under 35 U.S.C. 154(b) by 899 days.

(21) Appl. No.: 11/897,097

(22) Filed: Aug. 28, 2007

(51) Int. Cl.
*H01Q 1/24* (2006.01)
*H01Q 11/12* (2006.01)

(52) U.S. Cl. ..... 343/702; 343/742

(58) Field of Classification Search ..... 343/702, 343/742, 867, 895
See application file for complete search history.

(56) References Cited

U.S. PATENT DOCUMENTS 3,780,373 A 12/1973 Holst et al.
5,048,118 A * 9/1991 Brooks et al. ..... 455/156.1
5,142,292 A 8/1992 Chang
5,374,937 A * 12/1994 Tsunekawa et al. ..... 343/702
5,602,556 A 2/1997 Bowers
5,877,728 A 3/1999 Wu et al.
5,914,692 A 6/1999 Bowers et al.
5,943,017 A 8/1999 Cosenza et al.
6,018,326 A 1/2000 Rudisill
6,037,879 A 3/2000 Tuttle
6,147,655 A 11/2000 Roesner
6,304,223 B1 10/2001 Hilton et al.
6,353,420 B1 3/2002 Chung
6,378,774 B1 4/2002 Emori et al.
6,509,877 B2 * 1/2003 Masaki ..... 343/702
6,538,617 B2 3/2003 Rochelle
6,582,887 B2 6/2003 Luch
6,654,231 B2 * 11/2003 Teshima ..... 361/679.3
6,703,935 B1 3/2004 Chung et al.
6,853,087 B2 2/2005 Neuhaus et al.
7,072,690 B2 * 7/2006 Shin et al. ..... 455/557
7,154,449 B2 12/2006 Liu et al.
7,242,353 B2 * 7/2007 Hung et al. ..... 343/702

OTHER PUBLICATIONS

"XceedID Corporation: Basic Overview of Smart Card Technology" [online]. XceedID Corporation [retrieved on Jun. 29, 2007]: <URL: www.xceedid.com/pdf/XceedID-Smartcard-Overview.pdf>.
"NXP Semiconductors: Near Field Communication" [online]. NXP Semiconductors, 2006-2007 [retrieved on Aug. 28, 2007]: <URL: www.nxp.com/#/homepage/cb=[type=application.path=/200235/200165,final=200167]|[6]>.

* cited by examiner

*Primary Examiner* — Shih-Chao Chen
(74) *Attorney, Agent, or Firm* — Treyz Law Group; G. Victor Treyz; David C. Kellogg

(57) ABSTRACT

An electronic device such as a computer monitor is provided that has an antenna that supports near field communications. The electronic device may have a housing with conductive housing surfaces. A display may be mounted in the housing. The conductive housing surfaces may contain a dielectric-filled hole. The antenna may have a substrate and one or more loops of conductive traces. The loops may exhibit mirror symmetry. The loops may overlap the display and the conductive housing surface. The loops may surround an inner loop-free portion of the antenna. The loop-free portion of the antenna may overlap the hole. Ferrite layers may be interposed between the loops of the antenna that overlap the display and the loops of the antenna that overlap the conductive housing.

19 Claims, 10 Drawing Sheets

ELECTRONIC DEVICE WITH CONDUCTIVE HOUSING AND NEAR FIELD ANTENNA

BACKGROUND

This invention relates generally to wireless communications, and more particularly, to near field communications.

Short range wireless communications schemes are of growing interest for applications such as mobile commerce and electronic keys. Such communications schemes are characterized by working distances of about 4-8 inches or less. Devices may communicate using magnetic field induction in a frequency band such as the unlicensed radio-frequency communications band of 13.56 MHz. This type of radio-frequency communications is often referred to as near field communications.

In a typical scenario, a smart card, mobile telephone, key fob, or other handheld device wirelessly interacts with a host device such as a smart card reader when a user places the handheld device within range of the host (e.g., within a few inches).

Because of the potentially diverse set of applications for near field communications, it would be desirable to be able to incorporate near field communications antennas into a range of electronic devices.

SUMMARY

In accordance with an embodiment of the present invention, an electronic device is provided that has an antenna. The electronic device may be a computer monitor or other device with a display. The electronic device may include a housing in which the display is mounted. The housing may have conductive surfaces. For example, the housing may have substantially planar front, rear, and side surfaces.

The conductive surfaces of the housing may be provided with a hole. The hole may be filled with air or other dielectric. The antenna may be mounted in the housing overlapping the hole.

The antenna may be substantially planar and may have a substrate such as a flex circuit substrate. Conductive antenna traces may be formed on the flex circuit substrate. The conductive antenna traces may be formed in a spiral shape or as one or more loops. The loops of the antenna traces may be bisected by a line. The loops of antenna traces may exhibit mirror symmetry with respect to the bisecting line.

One or more conducting loops in the antenna may surround a loop-free region of the antenna. The antenna loops may overlap the display. The antenna loops may also overlap the conductive housing surface. The inner loop-free region of the antenna may overlap the hole in the conductive housing surface.

One or more layers of ferrite may be interposed between the antenna and conductive structures in the electronic device. For example, a layer of ferrite may be interposed between antenna loops that overlap the display and the display. A layer of ferrite may also be interposed between antenna loops that overlap the conductive housing surface and the conductive housing surface.

The antenna may support near field communications in a suitable frequency band such as the 13.56 MHz band.

Further features of the invention, its nature and various advantages will be more apparent from the accompanying drawings and the following detailed description of the preferred embodiments.

DETAILED DESCRIPTION

Figure 1:
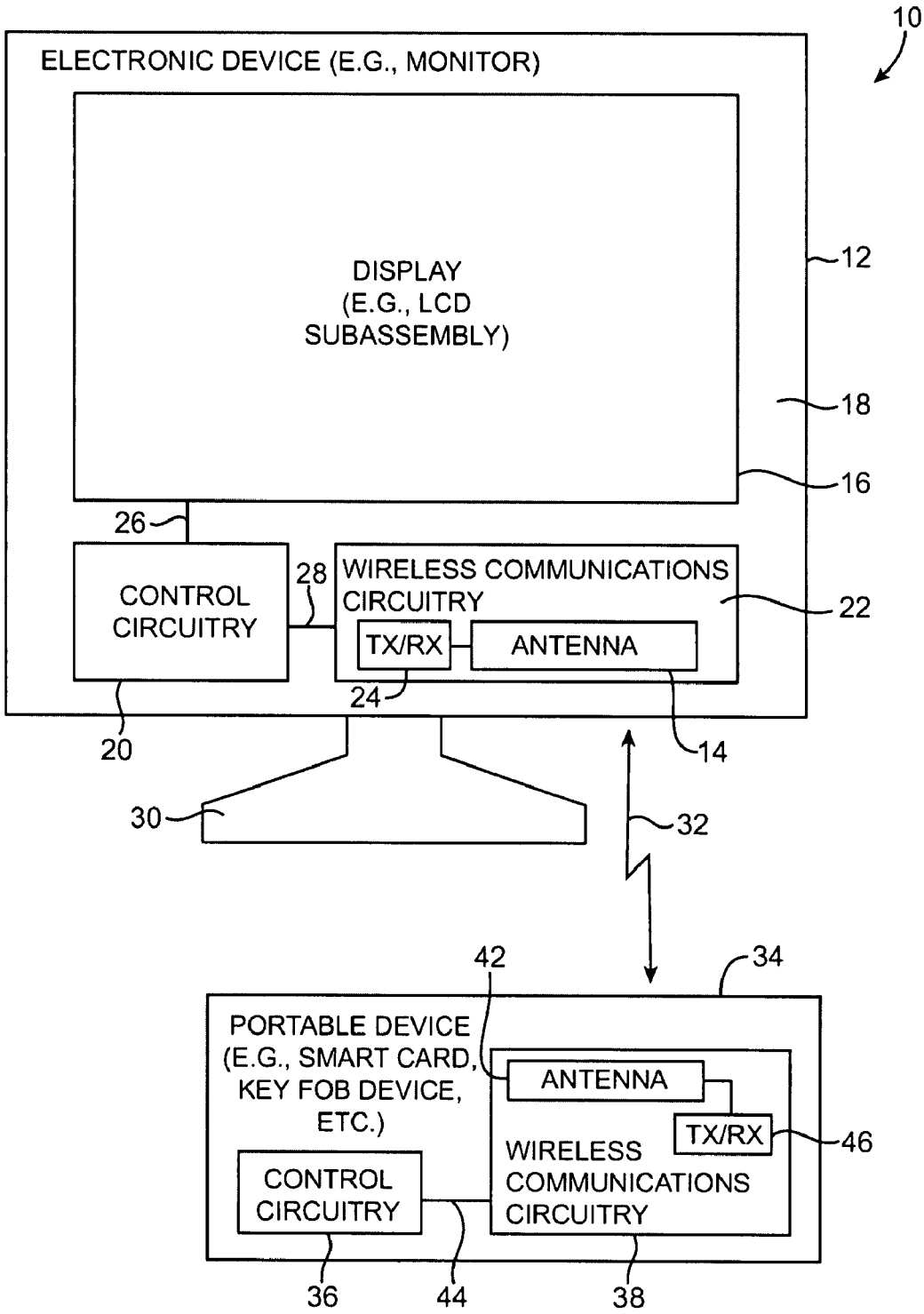
FIG. 1 is a diagram of an illustrative system that includes an electronic device such as a computer monitor with a near field communications antenna and a mobile electronic device such as a smart card with a near field communications antenna in accordance with an embodiment of the present invention.

The present invention relates generally to wireless communications, and more particularly, to wireless communications using near field wireless communications schemes.

Near field communications schemes are of interest for applications where long range communications such as traditional cellular telephone communications are inappropriate. Near field communications schemes rely on short-range electromagnetic coupling and typically operate at distances of 4-8 inches or less.

Because communications are generally not possible at distances larger than about 8 inches, near field communications schemes are useful in scenarios in which a user of the scheme must be physically present. As an example, near field communications schemes may be advantageous when implementing an electronic lock for a door. When a near field communications scheme is used to control access to a building in this way, only people who physically present their smart cards or other near field communications devices will be allowed to gain access to the building. As another example, an electronic payment scheme may benefit from requiring the physical proximity between a purchaser's mobile device and a point of sale terminal.

Because near field communications schemes rely on electromagnetic communications, conventional host devices such as smart card readers generally avoid the use of conductive enclosures for their antennas. This prevents signal loss due to the presence of conductive housing walls near the near field antennas that might otherwise prevent effective transmission and reception of wireless signals.

In accordance with an embodiment of the present invention, near field communications antennas and electromagnetic device housing arrangements for near field communications antennas are provided that allow use of near field antennas in a variety of contexts.

As an example, an electronic device such as a computer monitor may be provided that has an antenna located within a conductive exterior. The conductive exterior surfaces of the computer monitor may include, for example, conductive housing walls and a conductive display screen. The near field antenna may be located within the computer monitor in the vicinity of a dielectric-filled region (a hole) in the conductive housing surface.

Ferrite elements such as adhesive-backed ferrite tape (e.g., ferrite tape of about 0.8 mm thickness) may be used to reduce signal losses due to electromagnetic field interactions between the near field antenna's electromagnetic fields and conductive materials such as the conductive exterior surface of the computer monitor. With one suitable arrangement, a strip of ferrite tape may be placed immediately in front of an antenna to shield the antenna from a conductive housing wall. Another strip of ferrite material may be placed directly behind the antenna to prevent the antenna from being degraded due to the presence of a conductive liquid crystal diode (LCD) display screen.

A near field antenna may be formed in a planar arrangement using a thin substrate such as a flex circuit substrate. A flex circuit substrate may be, for example, 0.01 to 1 mm thick. The use of a thin planar substrate such as a flex circuit substrate allows the near field antenna to be incorporated into a computer monitor or other electronic device without taking up too much room. A typical antenna thickness may be about 0.08 mm.

The circuit traces on the flex circuit substrate may use a spiral antenna architecture, a loop architecture with conductive traces that exhibit mirror symmetry, or any other suitable arrangement. An advantage of forming a near field antenna whose conductive traces exhibit mirror symmetry is that this type of antenna layout tends to exhibit coherent electromagnetic field patterns and therefore interacts well with near field antennas in corresponding portable electronic devices (e.g., smart cards).

With one suitable arrangement, which is described herein as an example, the near field antenna is formed from eight concentric loops of conductive traces on a flex circuit substrate. Crossover connections may be made between adjacent loops of traces to ensure that the antenna has mirror symmetry. Because multiple antenna loops are used, antenna effectiveness is improved.

An illustrative system that includes an electronic device with a near field communications antenna is shown in FIG. 1. In the example of FIG. 1, electronic device 10 is a computer monitor. This is merely illustrative. Electronic device 10 may be any suitable equipment.

Electronic device 10 may contain control electronics, electrical components such as a display, fans, power supplies, input-output jacks, printed circuit boards, etc. Electronic device 10 may be, for example, a desktop or laptop computer, a router, a kiosk, a point of sale terminal, industrial equipment (e.g., on a factory floor), medical equipment, a printer, a camera, a mobile telephone, a media player, a handheld computer or other handheld device, a hard disk drive enclosure, or any other suitable electronic equipment. For clarity, the present invention will sometimes be described in connection with electronic devices such as computer monitors. This is, however, merely illustrative.

Device 10 may contain control circuitry such as control circuitry 20 and electrical components such as display 16 and wireless communications circuitry 22. The electrical components associated with device 10 may be mounted in a housing 12. Housing 12 may be formed of metals, conductive plastics, and other conductive materials, dielectrics such as plastics and glass, combinations of conductors and dielectrics, or any other suitable materials. A stand such as stand 30 or other suitable support structure may be used to help support housing 12. Stand 30 may be formed of plastic, metal, other suitable materials, or a combination of such materials.

Control circuitry 20 may be based on one or more integrated circuits, one or more printed circuit boards or other mounting structures on which integrated circuits are mounted, discrete electrical components, combinations of such circuitry, or any other suitable control circuitry. Integrated circuits that may be included in control circuitry 20 include microprocessors, microcontrollers, digital signal processors, application specific integrated circuits, field programmable gate arrays, video and audio chips, memory, etc.

Display 16 may be any suitable type of display, such as a plasma display, a liquid crystal diode (LCD) display, an organic light emitting diode (OLED) display, or any other display. The outermost surface of display 16 may be formed from one or more plastic or glass layers. If desired, touch screen functionality may be integrated into display 16. Although covered with insulating materials such as plastic or glass, most displays such as LCD display 16 contain a sufficient quantity of conductive components that they are conductive for electromagnetic purposes. If, for example, a conventional antenna were to be placed directly behind an LCD display, the conductive nature of the internal components of the LCD display would serve as radio-frequency shielding and would block electromagnetic fields emanating from the antenna.

As shown in FIG. 1, control circuitry 20 may communicate with display 16 using a communications path such as path 26. Control circuitry 20 may communicate with wireless communications circuitry 22 using a path such as path 28. The communications paths associated with device 10 may be formed using any suitable arrangement. For example, communications paths 26 and 28 may be formed using one or more electrical buses, traces on one or more printed circuit boards, optical paths, etc.

Wireless communications circuitry 22 may include transceiver circuitry 24 and antenna circuitry 14. Antenna circuitry 14 may include one or more antennas. The use of arrangements involving a single antenna are sometimes described herein as an example.

Transceiver circuitry 24 may include transceiver integrated circuits. For example, transceiver circuitry 24 may include a printed circuit board with multiple transceiver integrated circuits that share a single antenna 14 using time-division multiplexing, radio-frequency couplers, radio-frequency switches, etc. In a typical configuration, circuitry 24 may contain a single transceiver that supports radio-frequency communications over a near field communications band (e.g., 13.56 MHz).

Device 10 may communicate wirelessly with one or more external devices. As shown in FIG. 1, for example, device 10 may communicate with one or more portable electronic devices such as device 34 using wireless communications links such as wireless path 32.

Portable device 34 may be a handheld electronic device such as a cellular telephone, a media player, a handheld computer, a hybrid device that combines the functions of a cellular telephone, media player, and handheld computer, or any other suitable electronic device. Portable device 34 may be a security device such as a smart card, a key fob device, or other suitable compact wireless device. Some devices may contain wireless circuitry for communicating with local area networks (e.g., IEEE 802.11 networks), wireless circuitry for communicating with cellular base stations (e.g., using cellular telephone voice and data communications frequencies), etc.

With one suitable arrangement, which is described herein as an example, portable electronic device 34 communicates at least partly with antenna 14 using near field communications. In this type of situation, path 32 may be about 4-8 inches or less, 2-10 inches or less, 15 inches or less, or any other suitable near field communications range. As an example, path 32 may be less than about 5 inches.

Near field communications arrangements such as these may be particularly advantageous in situations in which it is desired to ensure that a particular user or device is in close physical proximity to electronic device 10. For example, if it is desired to offer a service to a particular person, it may be advantageous to ensure that the person (or at least their portable device 34) is at the same physical location as electronic device 10. Services that may be provided include financial services such as electronic payment services, building access, computer network access, etc.

As an example, consider the situation in which credentials stored on a security device such as a smart card or key fob are being used to verify a user's identity. In this type of arrangement, the use of near field communications is advantageous, because it requires that the security device be located within several inches of the electronic device 10.

Device 10 may be placed in a particular location such as within the confines of a building with restricted access, near a point of sale terminal for a merchant, at a reception desk of a building, or other location which benefits from the short-range nature of near field communications. For example, device 10 may be placed within the secure confines of a building, so that only those users who are able to gain entry to the building will be able to bring portable device 34 into near field communications with electronic device 10. As another example, electronic device 10 may be located at a merchant's point of sale terminal, so that an employee of the merchant (e.g., a cashier) will be present when a user makes an electronic payment or conducts other financial transactions. If device 10 is located at a reception desk of an organization, a receptionist may be able to visually monitor visitors to an organization as they bring portable device 34 into communication with electronic device 10.

Portable device 34 may have control circuitry 36. Control circuitry 36 may be based on one or more integrated circuits and discrete electronic components. Integrated circuits that may be included in control circuitry 20 include microprocessors, microcontrollers, digital signal processors, application specific integrated circuits, field programmable gate arrays, video and audio chips, memory, etc.

Control circuitry 36 may communicate with wireless communications circuitry 38 over a communications path such as path 44. Path 44 may include any suitable communications paths such as electrical buses, optical paths, etc.

Wireless communications circuitry 38 may include one or more antennas such as antenna 42 and transceiver circuitry 46. Transceiver circuitry 46 may include a printed circuit board with one or more transceiver integrated circuits. If portable device 34 is a handheld electronic device that communicates over cellular telephone bands, antenna circuitry 42 may include a cellular telephone antenna in addition to a near field communications antenna for communicating with antenna 14 over path 32. Such a device may also include one or more additional antennas (e.g., for local area network access, etc.). As another example, device 34 may be a smart card or key fob device that contains a single near field communications antenna 42.

Near field communications over path 32 may be supported using any suitable frequency band or bands. One suitable near field communications band that may be used for path 32 is the 13.56 MHz band. The communications protocol used for path 32 may be, for example, a protocol that is compliant with the ISO 18092 Standard promulgated by the International Organization for Standardization.

Figure 2:
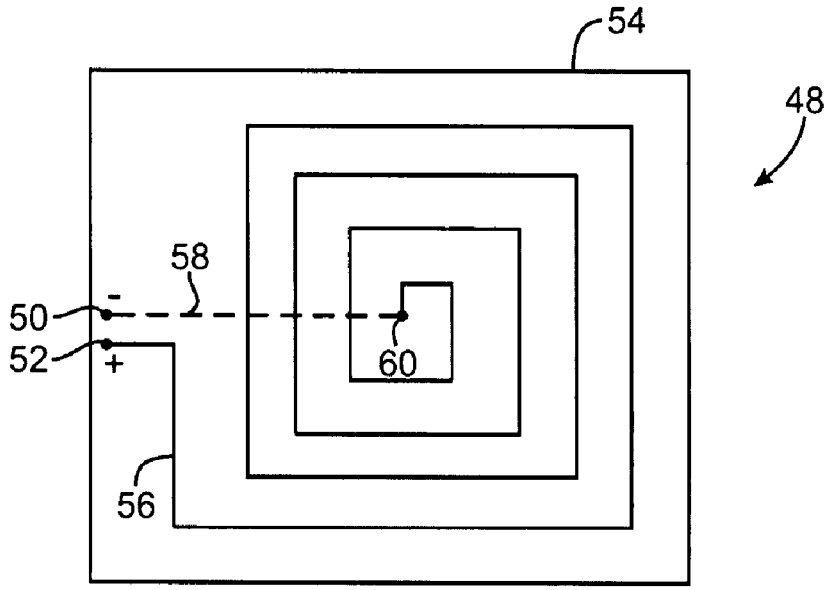
FIG. 2 is a top view of an illustrative antenna having a spiral conductor layout and a substantially square footprint in accordance with an embodiment of the present invention.

Any suitable antenna arrangement may be used for antennas 14 and 42. An illustrative near field communications antenna that may be used for one or both of these antennas is shown in FIG. 2. As shown in FIG. 2, antenna 48 may be constructed from a conductive line 56 that is formed in a generally spiral shape. Conductive line 56 may be formed on a substrate 54. Substrate 54 may be formed from a dielectric such as a rigid or flexible printed circuit board. With one suitable arrangement, line 56 may be a conductive trace such as a copper trace. Line 56 may be formed by screen printing, blanket deposition and etching, or any other suitable technique.

If desired, substrate 54 may be a flexible integrated circuit substrate formed from a polymer such as polyimide. Flexible circuit substrates such as these, which are sometimes referred to as flex circuits, may be relatively inexpensive to manufacture and relatively straightforward to handle during assembly operations. In the example of FIG. 2, substrate 54 has been formed in a generally square shape to match the generally square outline of the spiral trace 56. This is merely illustrative. Antenna substrate 54 may have any suitable shape (e.g., rectangular with sides of unequal length, oval, polygonal with no curved sides, polygonal with curved portions, circular, etc.

Antenna 48 may have a positive terminal 52 and a negative terminal 50. Terminal 52 may sometimes be referred to as a positive feed or positive antenna feed terminal. Terminal 50 may sometimes be referred to as a negative or ground feed.

Antennas that are spiral in shape such as the antenna of FIG. 2 may spiral inwards toward a central point such as point 60. A conductive line 58 may be used to connect the trace 56 at point 60 to ground terminal 50. Line 58 may be formed from a wire or a trace of conductor (e.g., copper). To prevent trace 58 from shorting adjacent coils of spiral trace 56, the spiral traces 56 and trace 58 may be insulated from one another by depositing a layer of polymer (e.g., polyimide) or other insulator between trace 56 and trace 58. If desired, trace 58 may be formed on the underside of a two-sided flex circuit. Wires or other suitable conductors may be electrically connected to antenna 54 and ground feed 50 and positive feed 52.

Figure 3:
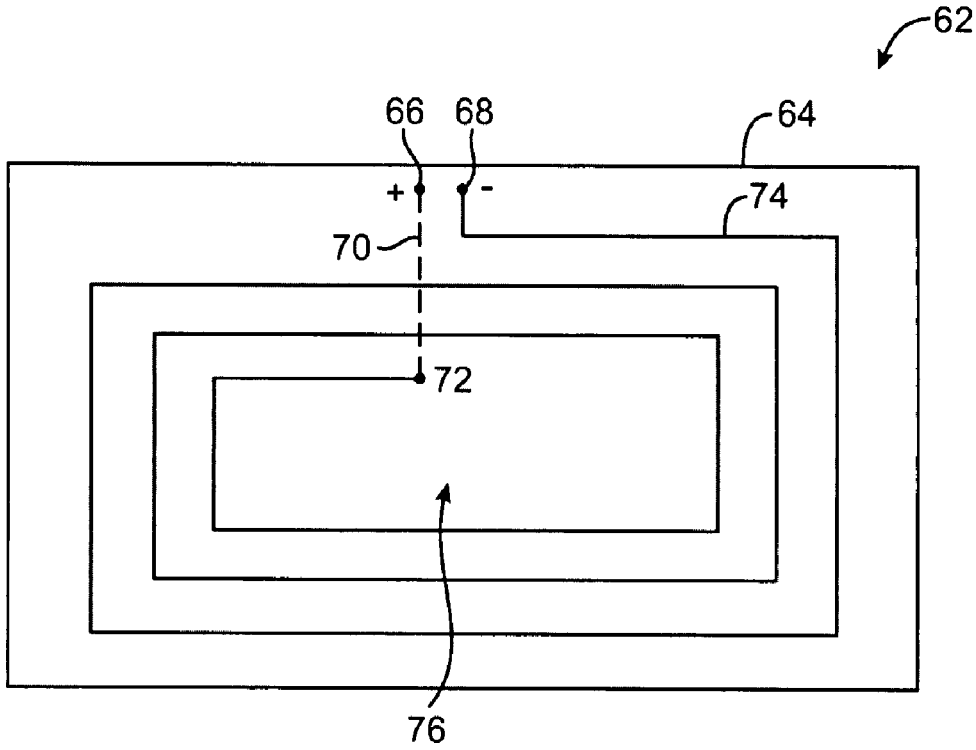
FIG. 3 is a top view of an illustrative antenna having a spiral conductor layout and a substantially rectangular footprint in accordance with an embodiment of the present invention.

Another illustrative antenna 62 that may be used to support communications over path 32 (e.g., near field communications) is shown in FIG. 3. As shown in FIG. 3, antenna 62 may be formed from a rectangular spiral of conductive lines 74

(e.g., a non-square spiral). Conductive line 70 may be used to connect the inner point 72 of conductive spiral 74 to an antenna feed terminal such as positive feed 66 or ground feed 68. In the example of FIG. 3, line 70 is used to connect point 72 to positive feed terminal 66, whereas ground feed terminal 68 is connected directly to spiral conductive line 74. Lines such as lines 74 and 70 may be formed from conductive traces such as copper traces on a substrate 64. Substrate 64 may be a rigid or flexible dielectric substrate such as a flex circuit.

In the arrangement of FIG. 2, antenna 48 has a conductive line 56 that spirals inwardly to a point 60. With the arrangement of FIG. 3, line 74 also spirals inwardly. However, with the arrangement of FIG. 3, a central area 76 remains uncovered by conductive lines. This central area may be, for example, 10%-50% or more of the total antenna area. The use of an antenna arrangement that has a conductor-free central area helps to ensure that the electromagnetic fields that emanate from the antenna are coherent and thereby improves the ability of the antenna to interact with a corresponding antenna over path 32.

Antenna arrangements of the types shown in FIGS. 2 and 3 are asymmetrical, because their antenna traces do not exhibit mirror symmetry. Symmetrical antenna arrangements may be advantageous, because they may exhibit superior electromagnetic field coherence and may therefore perform better than asymmetrical antennas.

Figure 4:
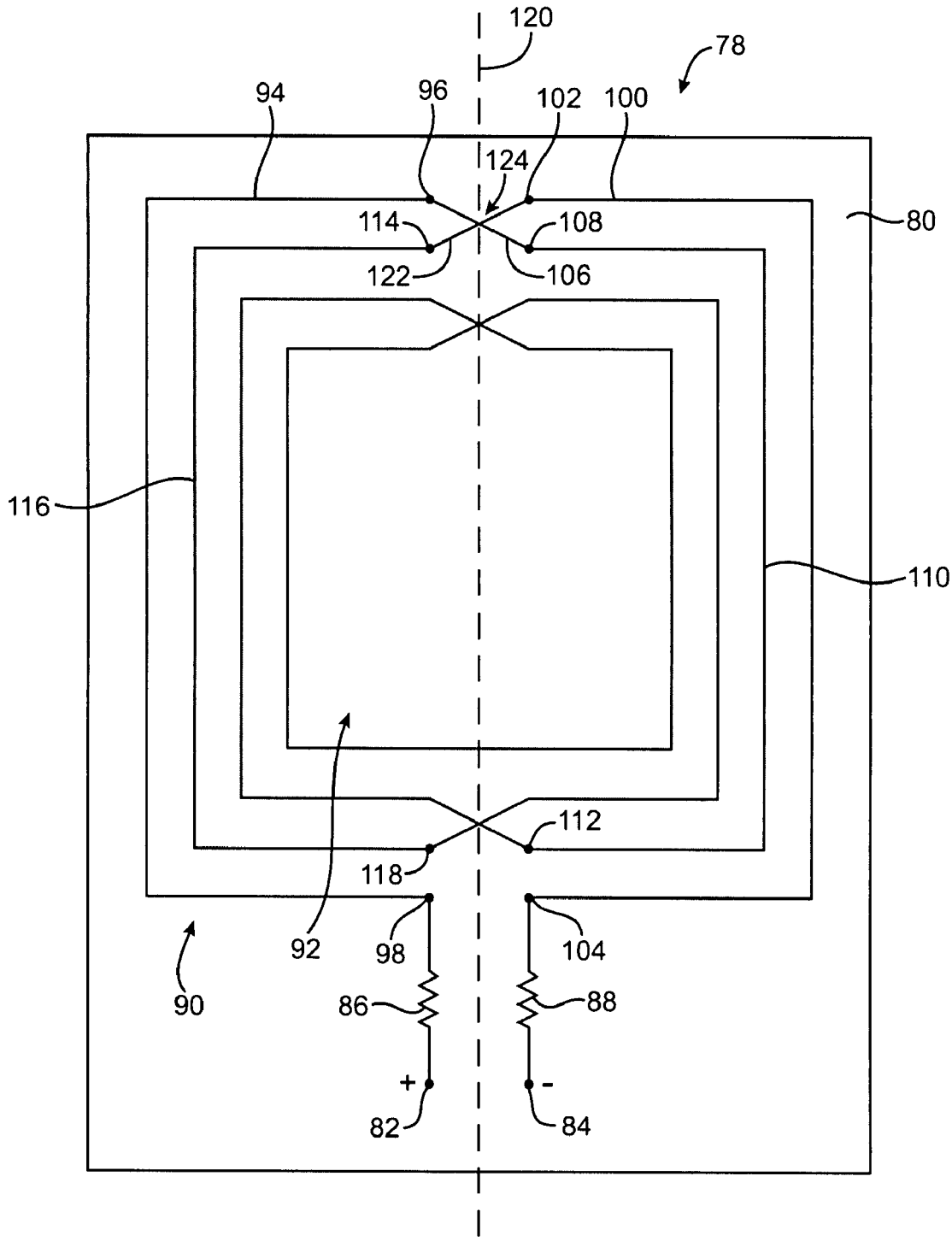
FIG. 4 is a top view of an illustrative antenna having a symmetric conductor layout with four loops of conductive traces in accordance with an embodiment of the present invention.

An illustrative symmetrical antenna 78 is shown in FIG. 4. Antenna 78 exhibits mirror symmetry, because one half of the antenna (i.e., the conductive antenna lines to the left of dotted bisecting line 120) is identical to the other half of the antenna (i.e., the antenna conductive lines to the right of dotted bisecting line 120).

Antenna 78 may be formed on a substrate 80. Substrate 80 may be a rigid or flexible dielectric such as a rigid printed circuit board or a polymer substrate such as a polyimide flex circuit substrate. The conductive lines of antenna 78 may be formed from wires or conductive traces. For example, copper traces or other conductive traces may be formed on substrate 80 by screen printing or by blanket conductive film deposition followed by wet or dry etching.

Antenna 78 may have positive terminal 82 (i.e., a positive antenna feed) and negative terminal 84 (i.e., an antenna ground feed). Resistors 86 and 88 (e.g., 3-4 ohm resistors) or other electrical components (e.g., a network of one or more resistors, capacitors, and inductors) may be provided to ensure that the impedance of antenna 78 is sufficiently matched to the impedance of transceiver circuitry 46 to prevent excessive radio-frequency signal reflections.

As shown in FIG. 4, each conductive line on the left side of dotted line 120 has a mating conductive line on the right of dotted line 120. As an example, consider conductive line 94 in antenna 78, which connects point 98 to point 96. Line 94 has an identical matching conductive line 100, which electrically connects points 102 and 104 on the right side of dotted line 120.

Moreover, identical crossovers are used to ensure that the conductive antenna lines in the inner portions of antenna 78 also exhibit mirror symmetry with respect to bisecting line 120. For example, line 94 is connected to crossover line 106 at point 96. Crossover line 106 connects point 96 and line 94 to point 108 and line 110. Line 110 connects crossover point 108 to point 112. In an identical fashion, line 100 is connected to crossover line 122 at point 102. Crossover line 122, which is a symmetric version of crossover line 106, connects point 102 and line 100 to point 114 and line 116. Line 116, which is identical to line 110, connects crossover point 114 to point 118. Just as line 110 exhibits mirror symmetry about bisection line 120 with respect to line 116, the other conductive traces of antenna 78 each exhibit mirror symmetry with respect to a corresponding conductive trace.

As a result of these relationships, all of conductive lines 90 in antenna 78 exhibit mirror symmetry with respect to bisecting dotted line 120. The symmetric layout of antenna 78 avoids the need for conductive traces such as traces 58 and 70 that run perpendicular to the loops of the antenna. The mirror symmetry of the loops and the avoidance of perpendicular traces helps to produce coherent electromagnetic fields during operation of antenna 78 and thereby helps ensure that antenna 78 will perform well when communicating over path 32.

Performance may also be enhanced by ensuring that there is an area 92 in the center of antenna 78 that is not covered by antenna traces. Area 92 may be any suitable shape (e.g., rectangular, square, etc.) and may have any suitable size. For example, area 92 may consume about 10-90% of the total area of antenna 78 (e.g., 10-90% of the total area of the antenna that lies within the outermost antenna loop).

To prevent short circuits, a layer of insulator may be formed between the conductive lines that cross over each other. For example, insulator may be placed between crossover line 122 and crossover line 106 to ensure that there is no electrical connection between lines 106 and 122 at point 124. The insulating layer may be a layer of polymer such as polyimide or any other suitable dielectric. The insulating layer may be deposited over the underlying conductive line during the process of fabricating antenna 78.

If desired, a two-sided flex circuit arrangement may be used for antenna 78. With this type of arrangement, one of the crossover lines (e.g., crossover line 122) may be formed on the top surface of flex circuit substrate 80, whereas the other of the crossover lines (e.g., line 106) may be formed on the lower (opposing) surface of flex circuit substrate 80. An advantage of using a symmetrical antenna arrangement for antenna 78 is that the backside crossover lines need not be overly large, thereby helping to minimize the thickness of the antenna.

Figure 5:
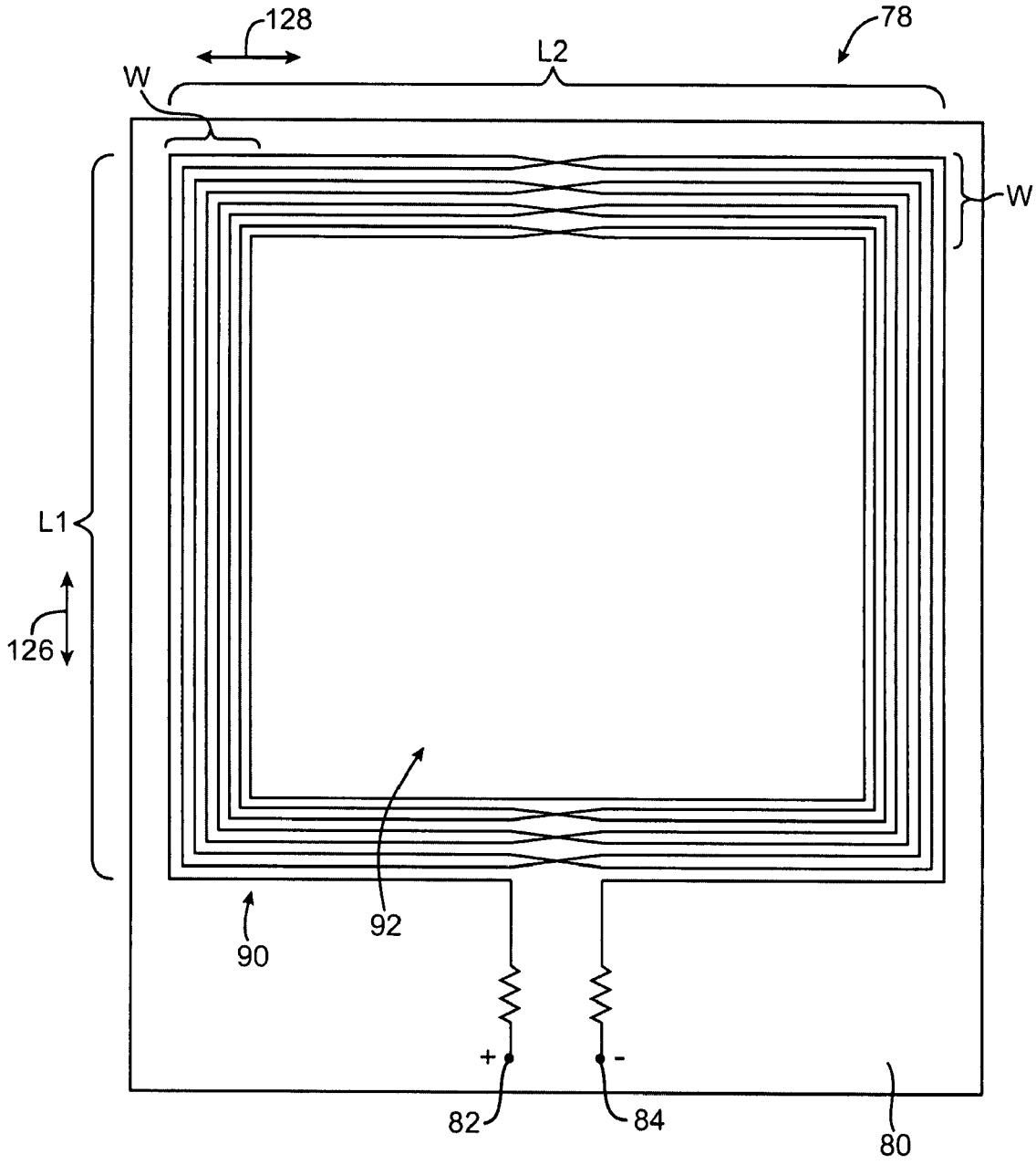
FIG. 5 is a top view of an illustrative antenna having a symmetric conductor layout with eight loops of conductive traces in accordance with an embodiment of the present invention.

The illustrative antenna of FIG. 4 has four conductive loops of lines 90 surrounding area 92. The use of multiple loops may help to improve antenna performance. If desired, fewer loops may be used (e.g., 1-3 loops) or more loops may be used, e.g., 4-12 or more than 12. Particularly good performance may be obtained when using antenna arrangements with about 8 loops. An illustrative antenna 78 that has been formed with eight loops of conductive traces 90 is shown in FIG. 5. The length L1 of antenna 78 in dimension 126 may be about 50 mm (as an example). The length L2 of antenna 78 in dimension 128 may be about 30 mm (as an example). The width W of the conductive loops 90 of antenna 78 may be about 8 mm (as an example). The width of the traces and the spaces between adjacent traces in loops 90 may be about 0.5 mm (as an example).

Antennas of the types described in connection with FIGS. 2-4 are merely illustrative. Other suitable antenna configurations may be used for antennas 42 and 44 if desired. For example, antennas 42 and 44 may have spiral loops formed in a circle, an oval spiral of loops, loops formed in a polygonal shape with no curved sides, loops formed in a polygon with at least one curved side, etc. These antenna shapes may use either asymmetrical layouts of the types described in connection with FIGS. 2 and 3 or symmetrical layouts of the type described in connection with FIGS. 4 and 5.

The antenna layouts used for antennas 42 and 14 may be the same (e.g., both using a FIG. 5 layout) or may be different. For example, a symmetrical layout of the type shown in FIGS. 4 and 5 may be used for antenna 14, while an asymmetrical layout may be used for antenna 42.

Antenna 14 may be mounted in housing 12 of device 10, even when housing 12 contains conductive portions. With one suitable arrangement, housing 12 is formed entirely (or almost entirely) out of conductive structures. Antenna 14 may be accommodated within this type of conductive housing arrangement by forming a region that is filled with air or other suitable dielectric. Ferrite tape may also be used to prevent radio-frequency signal degradation due to the proximity of conductive device structures to the conductive loops of antenna 14.

Figure 6:
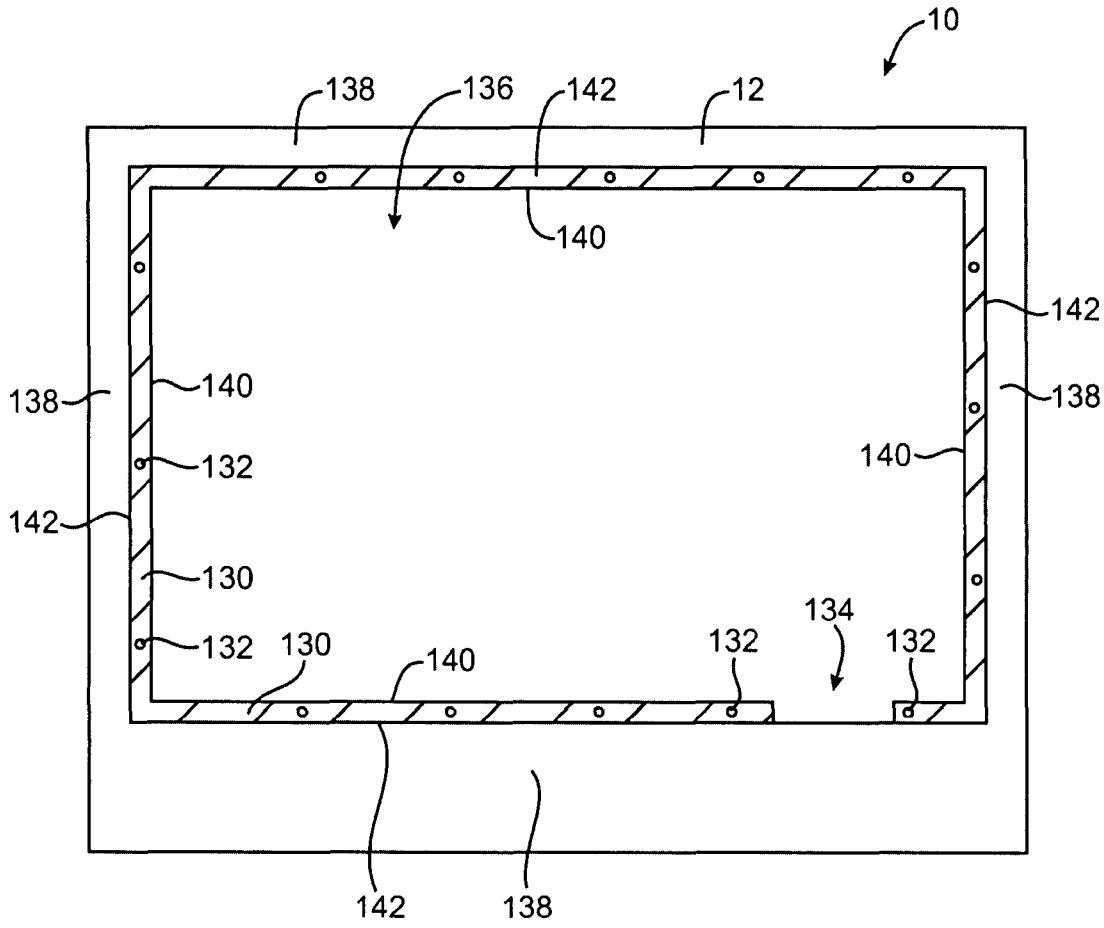
FIG. 6 is a front view of an illustrative computer monitor having a conductive housing surface with a dielectric-filled region that accommodates a near field communications antenna in accordance with an embodiment of the present invention.

An example is shown in FIG. 6. Housing 12 of FIG. 6 may be associated with a computer monitor or other device 10 having a display. Housing 12 may, as an example, be formed using aluminum, steel, metal alloys, or other metal structures. Planar metal structures for the walls of housing 12 may be about 0.05 to 1 mm thick (as an example). The front surface of housing 12 may have a hole 136 that is sized to accommodate a display such as display 16 of FIG. 1. Portions 138 of housing 12 may surround the central region formed by hole 136. A recessed lip 130 may be formed around the inner periphery of housing 12. Inner edge 140 of lip 130 may have dimensions that are able to accommodate display 16. Outer edge 142 of lip 130 may have dimensions that accommodate a clear protective panel formed of glass or plastic. Screw holes 132 may be formed in lip 130. Mating screws may be inserted into screw holes 132 (e.g., to hold a clear protective panel and/or a protective bezel into place on housing 12.

A hole or gap 134 may be formed in the conductive surface of housing 12. For example, a substantially rectangular hole 134 may be formed in housing 12 by removing a portion of lip 130, as shown in FIG. 6. Forming hole 134 in this way allows antenna 14 to operate. Without a hole in housing 12, the conductive walls of housing 12 and the conductive housing surface that is formed when display 16 is mounted to the front of device 10 would electromagnetically shield antenna 14 and prevent antenna 14 from communicating with device 34 over communications path 32.

Hole 134 may be formed in any portion of housing 12 and may have any suitable shape. With one illustrative arrangement, housing 12 includes at least one conductive surface. The conductive surface may, for example, be formed from sheets of metal or other conductors. Some of the conductive surfaces of device 10 may be formed by one or more electrical components. For example, part of a front conductive surface may be formed from a display such as display 16.

Conductive housing wall layers may be planar. For example, in a computer monitor, housing 12 may include a front surface that is partially formed from a planar display and that is partly formed from a planar conductive metal layer (e.g., an aluminum layer) that surrounds the display. In this type of arrangement, the conductive layer is planar. Hole 134 may be formed in any suitable conductive layer of housing 12, including planar or nonplanar side walls, planar or nonplanar front and rear surfaces, radiused or otherwise curved front, side, or rear surfaces, etc.

If desired, some of the walls of electronic device 10 may be formed from nonconductive materials. As an example, a rear housing surface, sidewall, or front housing surface of device 10 may be formed from plastic. Antenna 14 may be mounted behind one of these surfaces. In many situations, however, it may be desirable to place antenna 14 in a portion of housing 12 where there is little or no plastic present (e.g., on a conductive front or side wall of housing 12). Particularly in these situations, it may be advantageous to form a hole 134 in the conductive surface of housing 12 to accommodate the antenna.

There is generally a finite thickness associated with the conductive walls of housing 12 to accommodate the component in the interior of device 10. The finite thickness of the conductive walls may range from about 0.1 to 5 mm (e.g., when a conductive surface is formed from metal) to about 0.2 to 2 cm (e.g., when a conductive surface is formed from components such as an LCD display). Surfaces of housing 12 may include both relatively thin planar portions (e.g., metal wall portions) and relatively thicker planar portions (e.g., display portions) or may have substantially the same thickness throughout (e.g., a metal housing sidewall). Hole 134 may be formed in any of these housing surfaces. For example, if device 10 is a computer monitor, device 10 may have a planar front surface. The planar front surface may include a display and a conductive planar metal housing front surface surrounding the display. In this type of situation, hole 134 may be formed in the metal housing surface adjacent to the display. Hole 134 may be formed in a lip such lip 130 of housing surface 138 or in other portions of housing surface 138.

Figure 7:
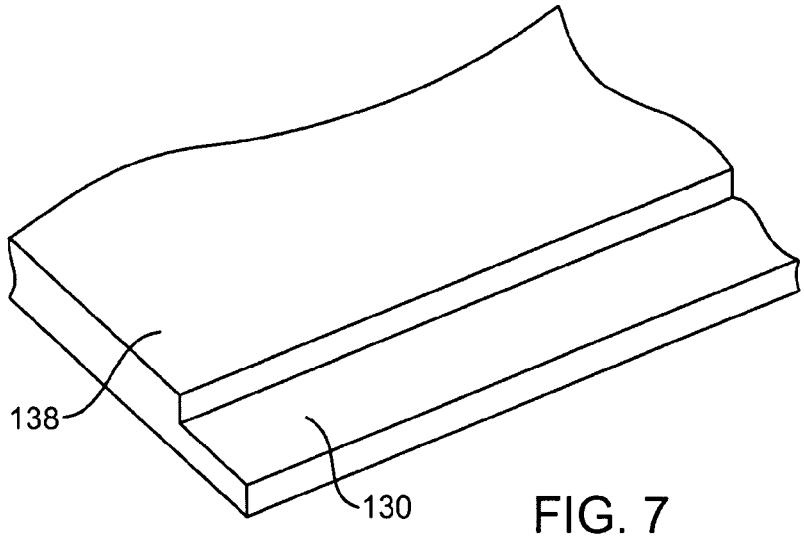
FIG. 7 is a perspective view of an illustrative portion of a conductive housing showing how a housing wall may have portions defining a lip in accordance with an embodiment of the present invention.
Figure 8:
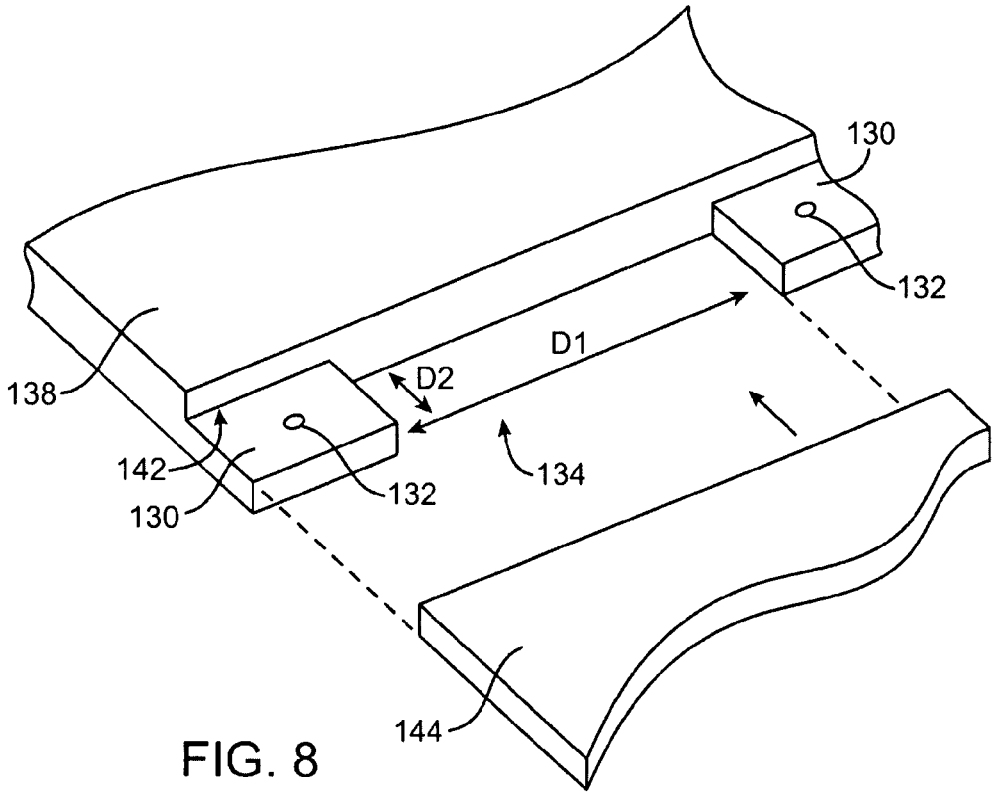
FIG. 8 is a perspective view of an illustrative portion of a conductive housing with a housing wall, portions defining a lip, and a hole in the lip in accordance with an embodiment of the present invention.

A portion of lip 130 is shown in FIG. 7. With the illustrative arrangement of FIG. 7, lip 130 is recessed sufficiently to allow a clear panel of glass or plastic to be mounted to portions 138 of housing 12. A portion of lip 130 in which dielectric-filled hole or region 134 has been formed is shown in FIG. 8. Hole 134 may have a length D1 and a width D2. These lateral dimensions may be adjusted to accommodate antenna 14. For example, if the longer lateral dimension of antenna 14 is 50 mm, lateral dimension D1 of hole 134 may be about 10 mm to 60 mm (as an example). If the shorter lateral dimension of antenna 14 is 30 mm, lateral dimension D2 of hole 134 may be about 8 mm or about 4 mm to 12 mm (as examples). These lateral dimensions are merely illustrative.

A plastic or glass cover may be attached to lip 130. A bezel may be used to cover the seam between the cover and edge 142 of lip 130. The plastic or glass cover for device 10 is represented by planar structure 144 in the example of FIG. 8.

Figure 9:
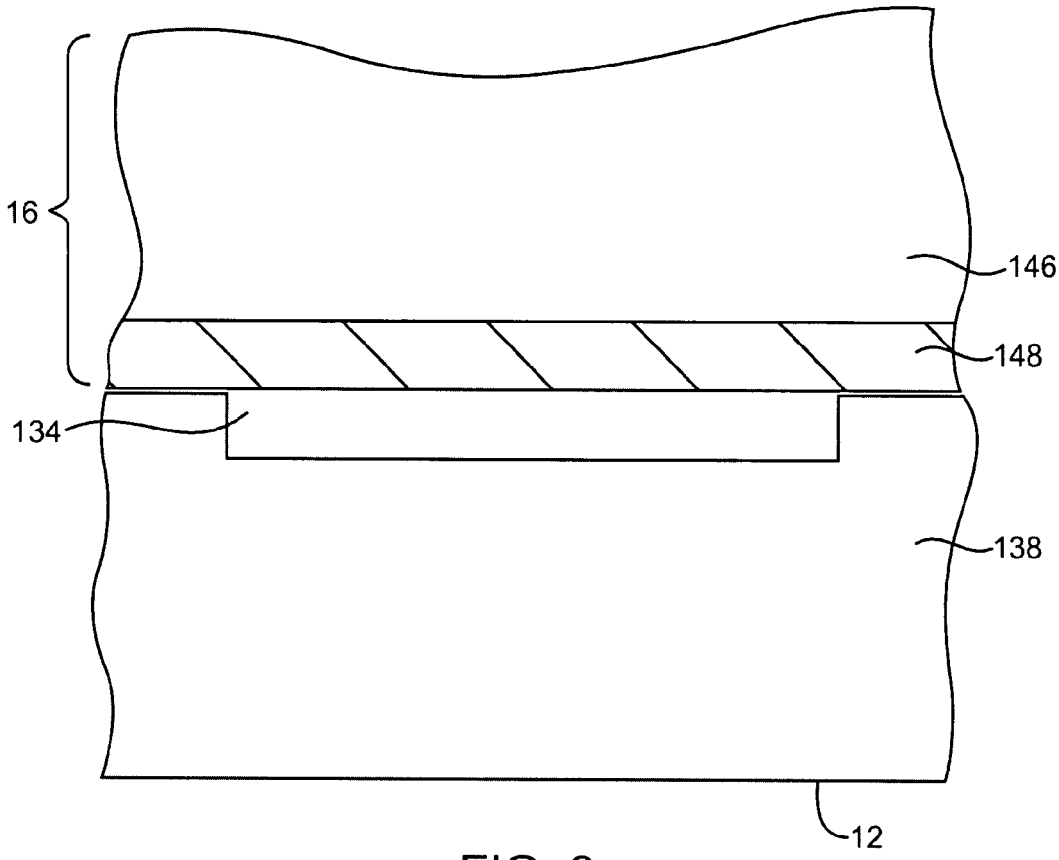
FIG. 9 is a front view of a portion of a conductive electronic device housing and an adjacent conductive electronic component such as a liquid crystal diode display that form a hole for an antenna in accordance with an embodiment of the present invention.

A top view of housing 12 in which a display such as display 16 of FIG. 1 has been placed is shown in FIG. 9. As shown in FIG. 9, some displays 16 may have an edge portion 148 and a central portion 146. Edge portion 148 may be covered in an external layer of metal, thereby rendering this portion of display 16 particularly conductive. Central portion 146 may not include any external metal or other external conductive portions. Nevertheless, display assemblies such as those used to form liquid crystal diode (LCD) displays contain numerous conductive components (e.g., transistors, conductive traces for addressing the transistors, conductive lines for distributing power, conductive structures for forming touch sensors, etc.). The conductive nature of the components that make up a display such as display 16 render the display conductive from the standpoint of radio-frequency signals. As a result, if a conventional antenna were to be placed directly behind a display, the conductive portions of the display would serve as electromagnetic shielding and would prevent the antenna from functioning. Similarly, it is generally not desirable to place an entire antenna directly behind a solid metal housing wall, because the conductive nature of the metal housing wall would block the radio-frequency signals from the antenna.

With the present invention, antenna 14 may be positioned within device 10 so that at least some of the antenna 14 overlaps with hole 134. A portion of antenna 14 may also be located on the exterior surface of the conductive structures of device 10 such as display 16. As a result, electromagnetic fields from antenna 14 are able to escape from within the confines of device 10, even though most of the surfaces of device 10 might be formed of metal, conductive display structures, or other conductive structures.

Figure 10:
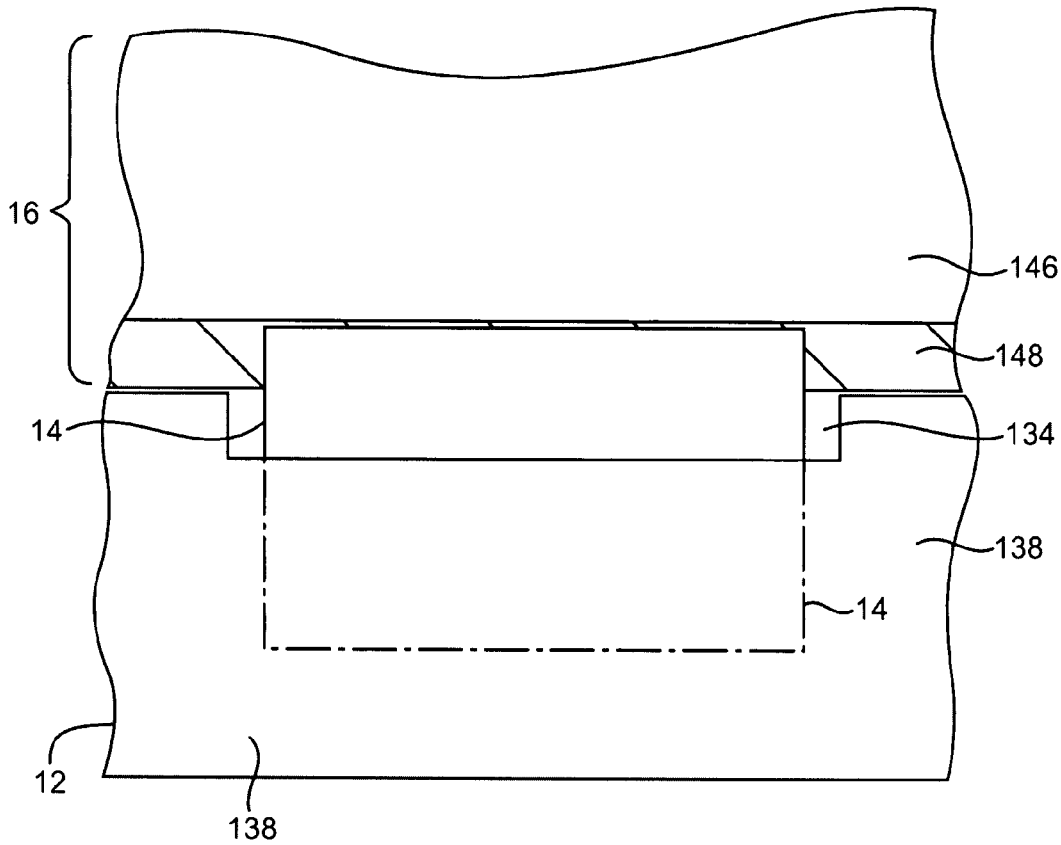
FIG. 10 is a front view of a portion of a conductive electronic device housing having a near field antenna that overlaps a hole in the device housing and an adjacent liquid crystal diode display in accordance with an embodiment of the present invention.

An illustrative location for antenna 14 relative to an illustrative hole 134 in conductive housing surface 12 is shown in FIG. 10. Part of the outline of antenna 14 is shown as a solid line and part of the outline of antenna 14 is shown as a dashed-and-dotted line. This is because the illustrative arrangement of FIG. 10 places the upper portion of antenna 14 in front of display 16 on the exterior surface of metal-covered edge 148 and places the lower portion of antenna 14 behind portion 138 in the interior of housing 12. There may be small exposed gaps at either end of antenna 14 when gap 134 is sized larger than antenna 14. Alternatively, gap 134 may be shorter, so that its length equals the longer lateral dimension of antenna 14.

When the loops of antenna 14 are placed in close proximity to conductive structures without shielding, the electromagnetic fields that are produced by the loops impinge directly on the conductive structures. The conductive structures then produce losses for the antenna. Particularly when the loops of a flat antenna such as antenna 14 are placed in direct contact with conductive surfaces, the losses induced by the conductive surfaces can be significant.

In the illustrative arrangement of FIG. 10, potentially significant losses may be produced for antenna 14, because the upper portion of antenna 14 lies on top of display 16 (e.g., on top of the outer surface of metal-encased edge 148) and because the lower portion of antenna 14 lies against the inner surface of the conductive wall formed by portion 138 of housing 12. To avoid these potential losses, one or more layers of ferrite tape or other suitable ferrite structures may be interposed between the rear surface of antenna 14 and underlying display 16 and between antenna 14 and overlying housing wall portion 138.

The layers of ferrite may be attached to housing 12 and antenna 14 using screws, clips, or other mechanical fasteners. With one particularly suitable arrangement, ferrite layers are attached to housing 12 and antenna 14 using adhesive. The adhesive may be part of the ferrite element (e.g., when using adhesive-backed ferrite tape) or may be applied separately. One or both sides of the ferrite layers may be coated with adhesive. Adhesive may be used by itself or in conjunction with mechanical fasteners.

Figure 11:
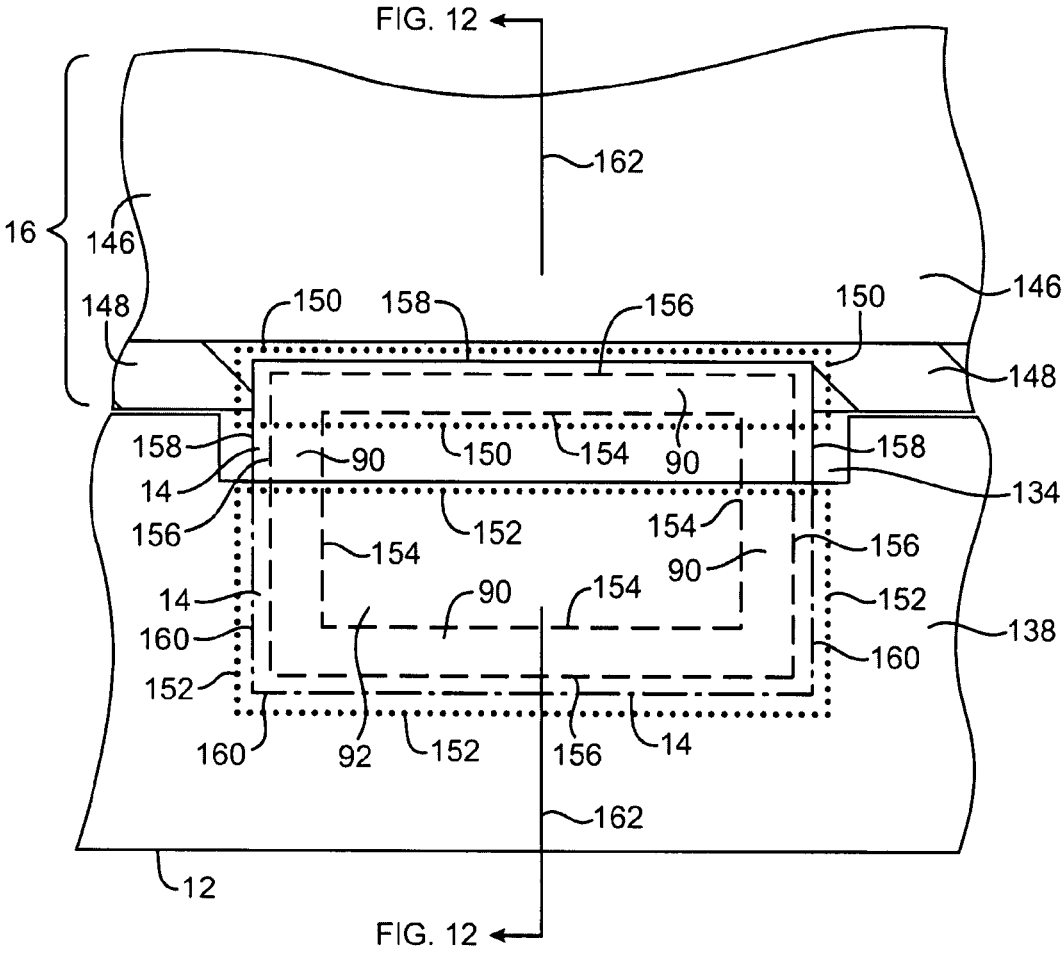
FIG. 11 is a front view of the portion of the conductive electronic device housing and display of FIG. 10 showing illustrative locations for ferrite materials that improve antenna performance in accordance with an embodiment of the present invention.

Illustrative positions were the ferrite layers may be placed relative to conductive loops 90 of antenna 14 and the surfaces of housing 12 and display 16 are shown in FIG. 11. In FIG. 11, the rectangular outline of substrate 80 of antenna 14 is depicted by solid line 158 and dashed-and-dotted line 160. The portion of the antenna substrate 80 that is depicted by solid line 158 lies on the exterior surface of display 16 (e.g., on top of display edge 148 and, if desired, on the exterior surface of adjacent central region 146 of display 16). The portion of antenna substrate 80 that is depicted by dashed-and-dotted line 160 lies adjacent to the interior surface of housing wall 138 (i.e., in the interior of device 10).

Device 10 may have a dielectric member such as a plastic bezel that serves to hold display 16 in place and that serves as a cosmetic cover. Some of planer antenna 14 lies on the exterior surface of the conductive structures of device 10 under the bezel or other dielectric member and some of planar antenna 14 lies on the interior of device 10. This arrangement allows antenna 14 to support near field communications over path 32, while remaining concealed from view. The portion of antenna 14 that lies above the display is able to interact with device 34 using near field communications, because the dielectric member conceals the antenna from view, but does not adversely affect antenna operation. The portion of antenna 14 that lies behind the conductive housing wall is concealed from view by the housing wall.

The location of conductive antenna loops 90 is shown by dashed lines 156 and 154. The outer perimeter of loops 90 is depicted by dashed lines 156. The inner perimeter of loops 90, which preferably surrounds trace-free region 92, is depicted by dashed lines 154. In the illustrative arrangement of FIG. 11, at least some of loop-free inner region 92 overlaps with hole 134, which helps to provide satisfactory antenna performance. Hole 134 may be filled with air, plastic, or any other suitable dielectric material that does not interfere with the electromagnetic fields produced by antenna 14.

As shown in FIG. 11, the area of antenna 14 (i.e., the area defined by the outermost loop 90) may be larger than the area of hole 134. The area of loop-free region 92 may also be larger than the area of hole 134. Moreover, loops 90 may not overlap hole 134. If desired, however, antennas of different sizes may be used and some or all of loops 90 may overlap hole 134. With one illustrative arrangement, at least some of trace-free region 92 overlaps hole 134 to ensure satisfactory communications with device 34 over wireless link 32. Arrangements in which all of loops 90 and all of loop-free region 92 lie within the boundaries of hole 134 may be used, although this type of layout may consume a relatively large amount of surface area on housing 12 of electronic device 10 and may require a relatively large bezel or other cosmetic cover to conceal. Hole 134 may be formed within lip 130 or other such housing wall structures that are concealed from view.

If desired, antenna arrangements of the type shown in FIG. 2 that do not have loop-free inner regions may be used in device 10. When antennas of this type are used, their loops may overlap at least part of hole 134 or lie entirely within hole 134.

As shown in FIG. 11, loops 90 lie on the exterior surface of display 16 (e.g., on conductive display edge 148). Accordingly, a layer of ferrite tape or other suitable magnetic shielding material may be placed between the rear (inner) surface of antenna 14 and display 16, where shown by dotted line outline 150. Similarly, a layer of ferrite tape or other suitable magnetic shielding material may be placed between the front (outer) surface of antenna 14 and the wall of housing 12, where shown by dotted line outline 152. The presence of the ferrite layers helps to prevent the adjacent conductive structures of housing 12 from excessively degrading antenna performance.

Figure 12:
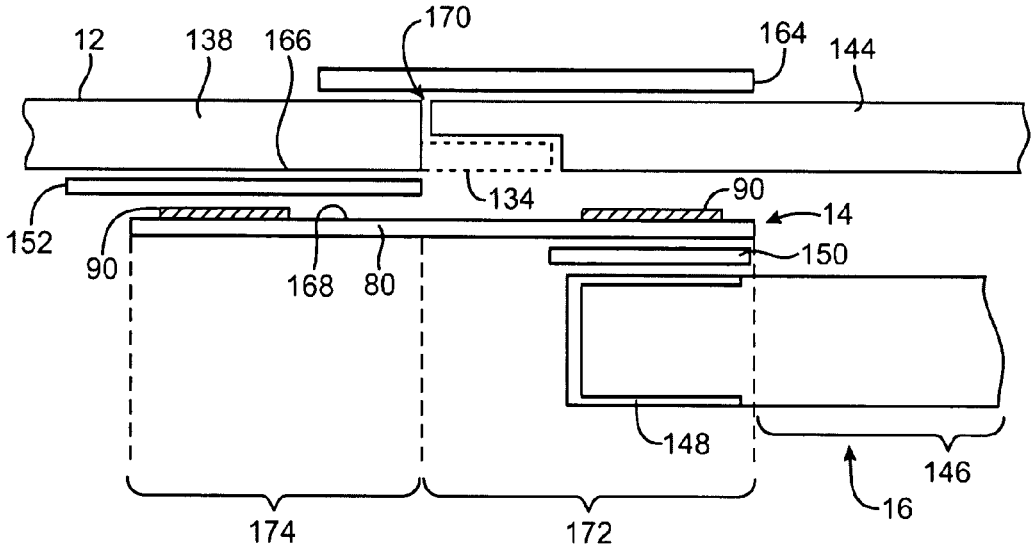
FIG. 12 is a cross-sectional side view taken along the cross-sectional line of FIG. 11 in accordance with an embodiment of the present invention.

A cross-sectional somewhat exploded side view of the structures of FIG. 11, as taken along line 162 of FIG. 11, is shown in FIG. 12. As shown in FIG. 12, display 16 may have a region such as region 148 that is coated with a layer of conductive material such as metal. This metal and the inner portion 146 of display 16 are conductive and can interfere with the electromagnetic fields produced by the loops of conductor in antenna 14. Ferrite layer 150 may therefore be placed on top of display 16 and metal portion 148 (i.e., between the exterior surface of display 16 and the inner surface of antenna 14). Ferrite layer 152 may be placed on top of antenna 14 (i.e., between exterior surface 168 of antenna 14 and interior surface 166 of housing wall 138). Gap 134 is preferably not blocked by ferrite. A bezel such as bezel 164 or other cosmetic dielectric cover may be used to hide the seam at junction 170 between display cover 144 and housing wall 138.

Portion 172 of antenna 14 lies on the exterior side of all conductive device structures (such as display 16 in the FIG.

12 example). Portion 174 of antenna 14 lies on the interior side of conductive housing wall 138. Dielectric member 164 may extend sufficiently far over the edge of display 16 to hide portion 172 of antenna 14 and edge 148 from view from the exterior of device 10. Optional transparent protective cover 144 for display 16 may be formed from dielectric, so that it does not interact with the operation of antenna 14.

The foregoing is merely illustrative of the principles of this invention and various modifications can be made by those skilled in the art without departing from the scope and spirit of the invention.

What is claimed is:

1. An electronic device, comprising:

a housing having a conductive housing surface;

a dielectric-filled region in the conductive housing surface; and a substantially planar antenna that at least partly overlaps the dielectric-filled region, wherein the conductive housing surface comprises a metal surface and a display having an exterior surface, wherein the metal surface surrounds the display, wherein the dielectric-filled region is formed in the metal surface, and wherein a portion of the planar antenna lies on the exterior surface of the display.

2. The electronic device defined in claim 1 wherein the substantially planar antenna comprises a near field communications antenna having at least one antenna loop.

3. The electronic device defined in claim 1, wherein the display comprises a computer monitor having a planar display, wherein the metal surface comprises a layer of metal, wherein the layer of metal surrounds the display, wherein the layer of metal comprises a lip, and wherein the dielectric-filled region is formed in the lip.

4. The electronic device defined in claim 3, wherein:

the antenna comprises a substrate and a plurality of conductive loops formed on the substrate;

the plurality of conductive loops are bisected by a line;

the plurality of conductive loops exhibit mirror symmetry with respect to the bisecting line;

the plurality of conductive loops surround a loop-free region of the antenna; and the antenna is attached to the electronic device so that at least some of the loop-free region overlaps the dielectric-filled region and so that a portion of the antenna lies on the exterior surface of the display.

5. The electronic device defined in claim 3 further comprising at least one layer of ferrite interposed between the conductive housing surface and the antenna, wherein:

the antenna comprises a substrate and a plurality of conductive loops formed on the substrate;

the plurality of conductive loops are bisected by a line;

the plurality of conductive loops exhibit mirror symmetry with respect to the bisecting line;

the plurality of conductive loops surround a loop-free region of the antenna; and the antenna is attached to the electronic device so that at least some of the loop-free region overlaps the dielectric-filled region.

6. The electronic device defined in claim 1 wherein the antenna comprises:

a substrate; and a plurality of conductive loops formed on the substrate, wherein the plurality of conductive loops surround a loop-free region of the antenna, and wherein the antenna is attached to the electronic device so that at least some of the loop-free region overlaps the dielectric-filled region.

7. The electronic device defined in claim 1 wherein the antenna comprises:

at least one conductive loop, wherein the conductive loop is bisected by a line and wherein the conductive loop exhibits mirror symmetry with respect to the bisecting line.

8. The electronic device defined in claim 1 wherein the antenna comprises:

a substrate; and a plurality of conductive loops formed on the substrate, wherein the plurality of conductive loops are bisected by a line and wherein the plurality of conductive loops exhibit mirror symmetry with respect to the bisecting line.

9. The electronic device defined in claim 1 wherein the antenna comprises:

a substrate;

a plurality of conductive loops formed on the substrate, wherein the plurality of conductive loops are bisected by a line, wherein the plurality of conductive loops exhibit mirror symmetry with respect to the bisecting line, wherein the plurality of conductive loops surround a loop-free region of the antenna, and wherein the antenna is attached to the electronic device so that at least some of the loop-free region overlaps the dielectric-filled region.

10. The electronic device defined in claim 1 wherein:

the antenna comprises a substrate and has a plurality of conductive loops formed on the substrate;

the plurality of conductive loops are bisected by a line;

the plurality of conductive loops exhibit mirror symmetry with respect to the bisecting line;

the plurality of conductive loops surround a loop-free region of the antenna; and the antenna is attached to the electronic device so that at least some of the loop-free region overlaps the dielectric-filled region.

11. The electronic device defined in claim 1 further comprising a layer of ferrite interposed between the antenna and the conductive housing surface.

12. The electronic device defined in claim 1 wherein the antenna comprises a plurality of loops and communicates using near field communications at a frequency of 13.56 MHz.

13. An electronic device, comprising:

a housing having a conductive housing surface;

a dielectric-filled region in the conductive housing surface;

a substantially planar antenna that at least partly overlaps the dielectric-filled region;

a display mounted in the conductive housing surface, wherein the planar antenna comprises a loop antenna having a plurality of loops, wherein the loops overlap at least part of the display, and wherein the loops overlap at least part of the conductive housing surface;

first and second layers of ferrite, wherein the first layer of ferrite is interposed between the display and the loops that overlap the display and wherein the second layer of ferrite is interposed between the conductive housing surface and the loops that overlap the conductive housing surface.

14. A computer monitor, comprising:

a display;

a conductive housing wall in which the display is mounted, wherein a dielectric-filled region is formed in the conductive housing wall; and a near-field communications antenna mounted in the computer monitor that overlaps the dielectric-filled region, wherein the near-field communications antenna has at least one antenna loop.

15. The computer monitor defined in claim 14, wherein the antenna comprises:

a flex circuit substrate; and a plurality of conductive traces that form loops on the flex circuit substrate surrounding a loop-free region on the flex circuit substrate, wherein the antenna is mounted to the computer monitor so that some of the loops overlap the conductive housing surface, some of the loops overlap the display, and at least a portion of the loop-free region overlaps the dielectric-filled region.

16. The computer monitor defined in claim 14, wherein the antenna comprises:

a flex circuit substrate;

a plurality of conductive traces that form loops on the flex circuit substrate surrounding a loop-free region on the flex circuit substrate, wherein the antenna is mounted to the computer monitor so that some of the loops overlap the conductive housing surface, some of the loops overlap the display, and at least a portion of the loop-free region overlaps the dielectric-filled region; and a layer of ferrite interposed between the antenna and an interior surface of the conductive housing wall.

17. An electronic device, comprising:

planar conductive structures having interior surfaces and exterior surfaces; and a substantially planar near-field communications antenna, wherein a portion of the antenna lies on a given one of the interior surfaces of the planar conductive structures and wherein a portion of the antenna lies on a given one of the exterior surfaces of the planar conductive structures.

18. The electronic device defined in claim 17 wherein the planar conductive structures have portions defining a hole, wherein the antenna comprises a plurality of conductive traces that exhibit mirror symmetry and comprises a central trace-free region, and wherein at least a portion of the trace-free region overlaps the hole, the electronic device further comprising:

a first layer of ferrite interposed between the antenna and the given one of the exterior surfaces of the planar conductive structures; and a second layer of ferrite interposed between the antenna and the given one of the interior surfaces of the planar conductive structures.

19. The electronic device defined in claim 17, wherein the planar conductive structures comprise a display and a metal housing wall, wherein the antenna lies on an interior surface of the metal housing wall, and wherein the antenna lies on an exterior surface of the display.

* * * * *